US008176579B2

(12) United States Patent
Daniels

(10) Patent No.: US 8,176,579 B2
(45) **Date of Patent: *May 15, 2012**

(54) MODULAR SHOWER PAN

(76) Inventor: Madison Daniels, Edmonton (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/184,781

(22) Filed: Jul. 18, 2011

(65) Prior Publication Data

US 2011/0271440 A1 Nov. 10, 2011

Related U.S. Application Data

(62) Division of application No. 11/852,556, filed on Sep. 10, 2007, now Pat. No. 7,979,927.

(51) Int. Cl.
*A47K 3/00* (2006.01)

(52) U.S. Cl. ..... 4/613; 4/612; 4/661; 52/302.1

(58) Field of Classification Search ..... 4/612–613, 4/596, 661; 52/302.1, 302.3, 302.4
See application file for complete search history.

(56) References Cited

U.S. PATENT DOCUMENTS 4,541,132 A 9/1985 Long

FOREIGN PATENT DOCUMENTS

CA 2 556 881 A1 9/2005

OTHER PUBLICATIONS

Schulter Systems (Canada) Inc., Schulter Shower System Brochure, available at least as early as 2005.
Ontario Tile Setters, Shower Floor website, available at www.ontariotile.com, available at least as early as Jul. 3, 2006.

*Primary Examiner* — Gregory Huson
*Assistant Examiner* — Karen L Younkins
(74) *Attorney, Agent, or Firm* — Davis & Bujold, P.L.L.C.

(57) ABSTRACT

A modular shower pan includes at least four polygon panels adapted to interlock in side by side relation to form a body. Each panel has a planar bottom surface and a top surface that is sloped based upon a pre-selected drain position on the body.

13 Claims, 4 Drawing Sheets

MODULAR SHOWER PAN

FIELD

The present invention relates to a shower pan that is modular.

BACKGROUND

Shower pans must have a correct slope for proper drainage. Conventional systems use mortar laid over an underlying waterproof liner. An integrated waterproofing system that includes a polystyrene floor pan is marketed by Schluter Systems in standard sizes.

SUMMARY OF THE INVENTION

According to the present invention there is provided a modular shower pan. The modular shower liner comprises at least four polygon panels adapted to interlock in side by side relation to form a body. Each panel has a planar bottom surface and a top surface that is sloped based upon a preselected drain position on the body.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION

Figure 1:
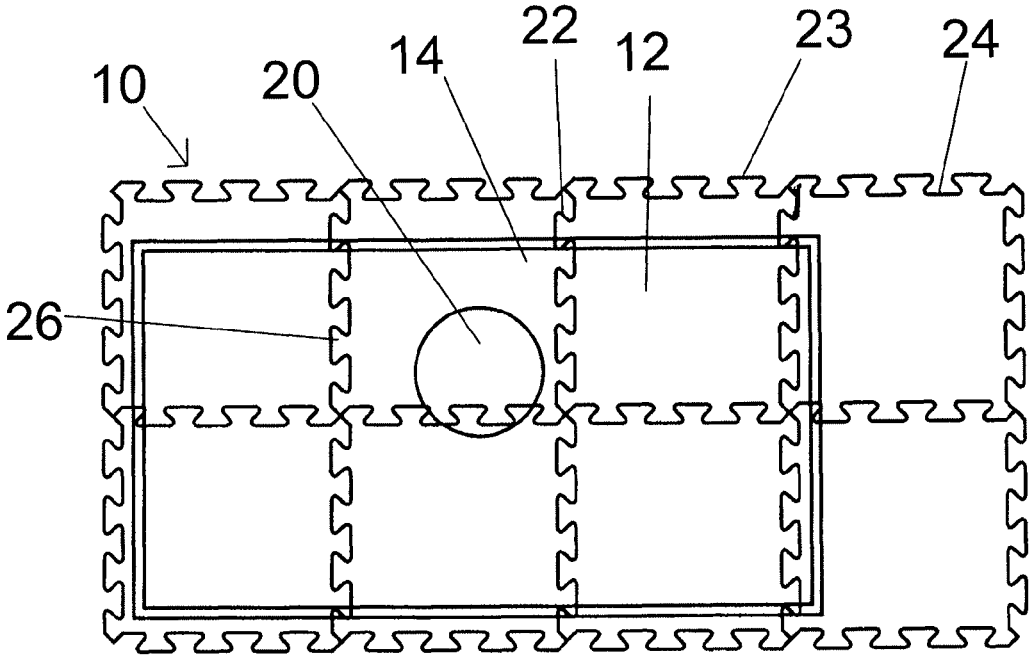
FIG. 1 is a top plan view of a modular shower pan in the process of being fabricated at a fabrication facility.

A modular shower pan generally identified by reference numeral 10, will now be described with reference to FIG. 1 through 8.

Figure 2:
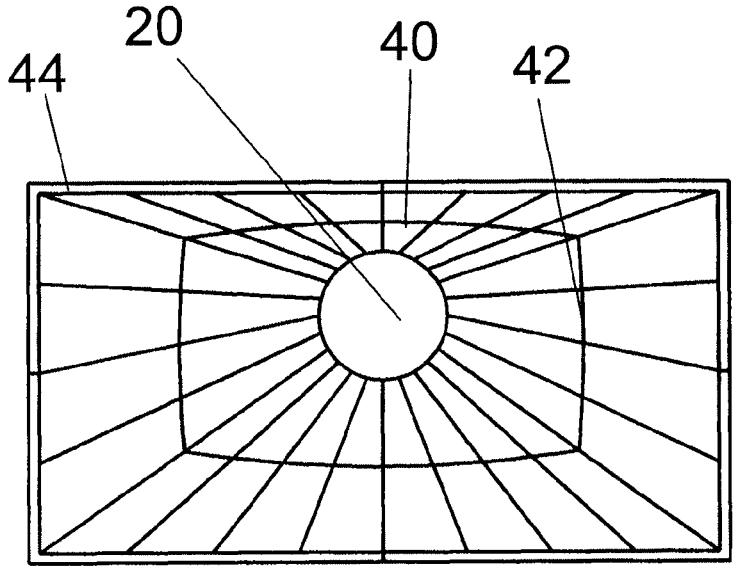
FIG. 2 is a top plan view of a modular shower pan prior to shipping showing topographical drainage detail.
Figure 3:
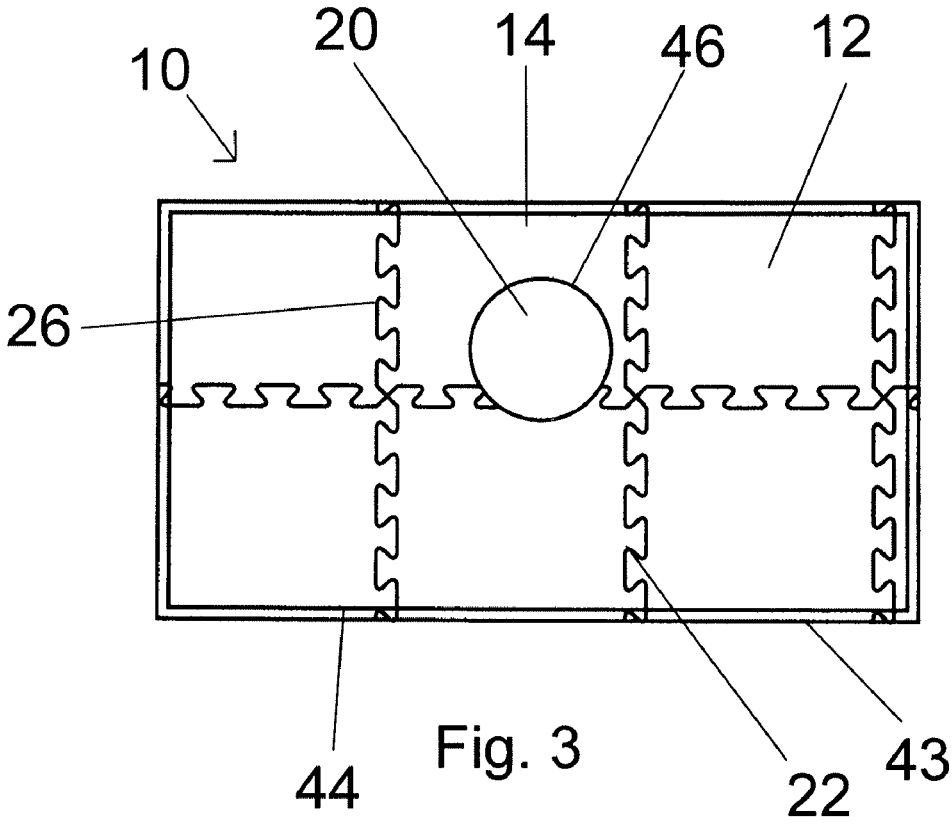
FIG. 3 is a top plan view of an installed modular shower pan.
Figure 4:
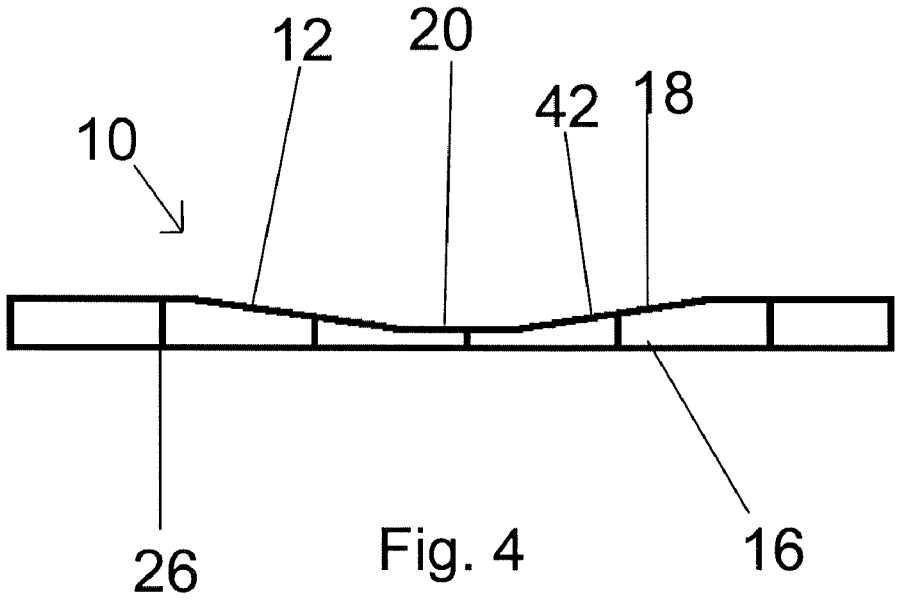
FIG. 4 is a side plan view in section of the installed modular shower pan.
Figure 5:
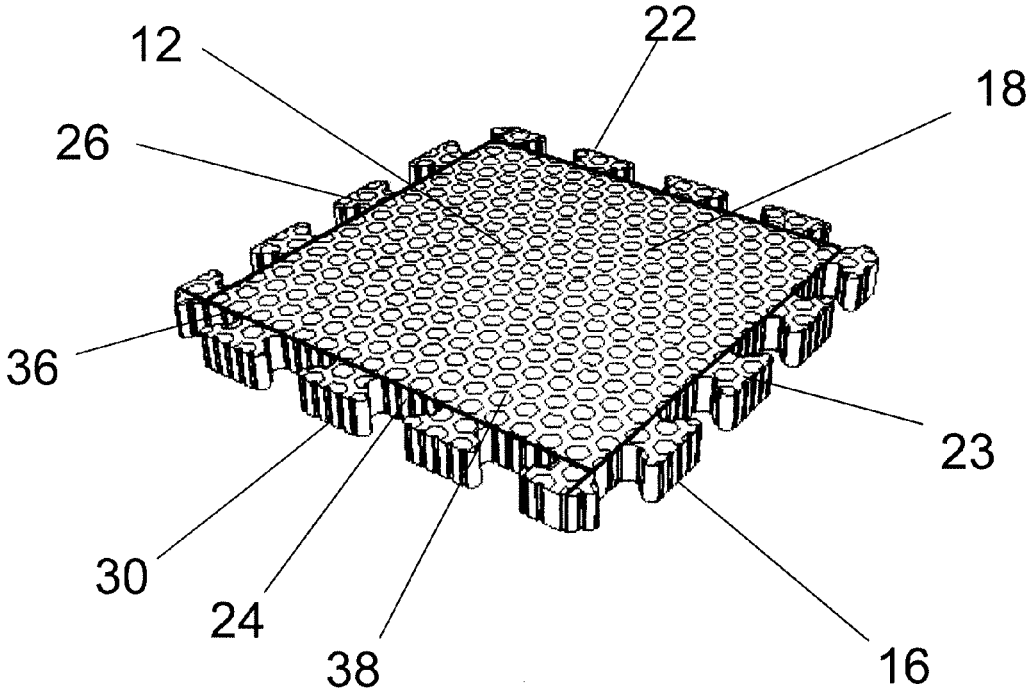
FIG. 5 is a perspective view of an individual panel.
Figure 6:
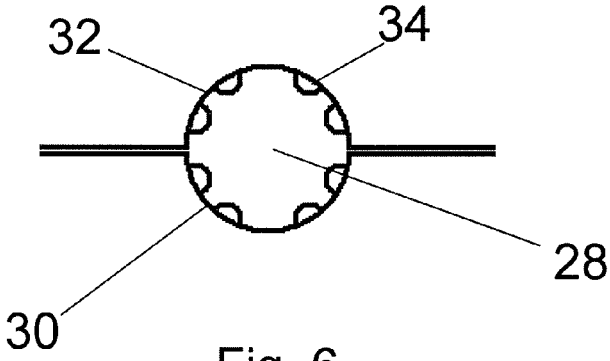
FIG. 6 is a detailed top plan view of a glue channel.
Figure 8:
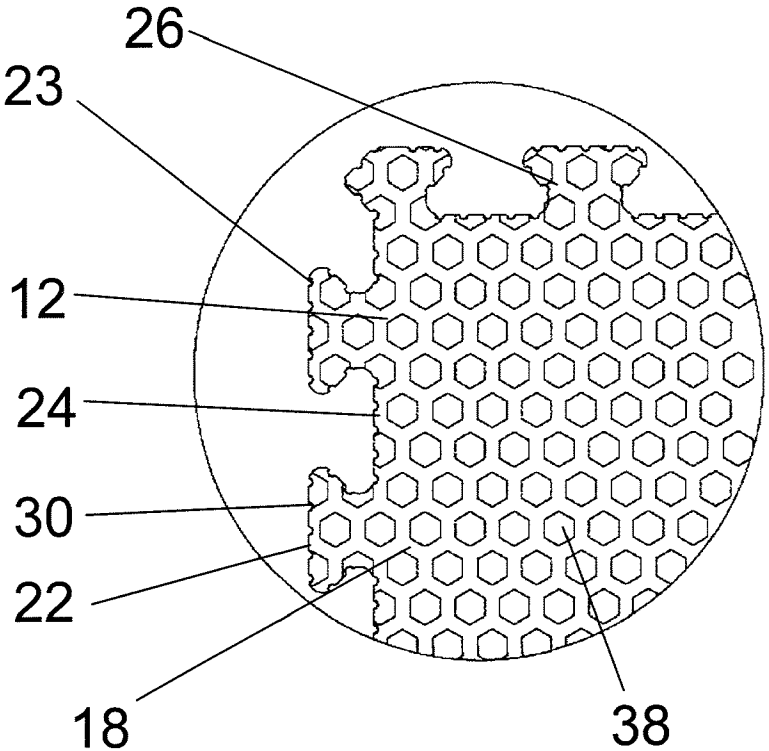
FIG. 8 is a detailed top plan view of the panel illustrated in FIG. 7.
Figure 7:
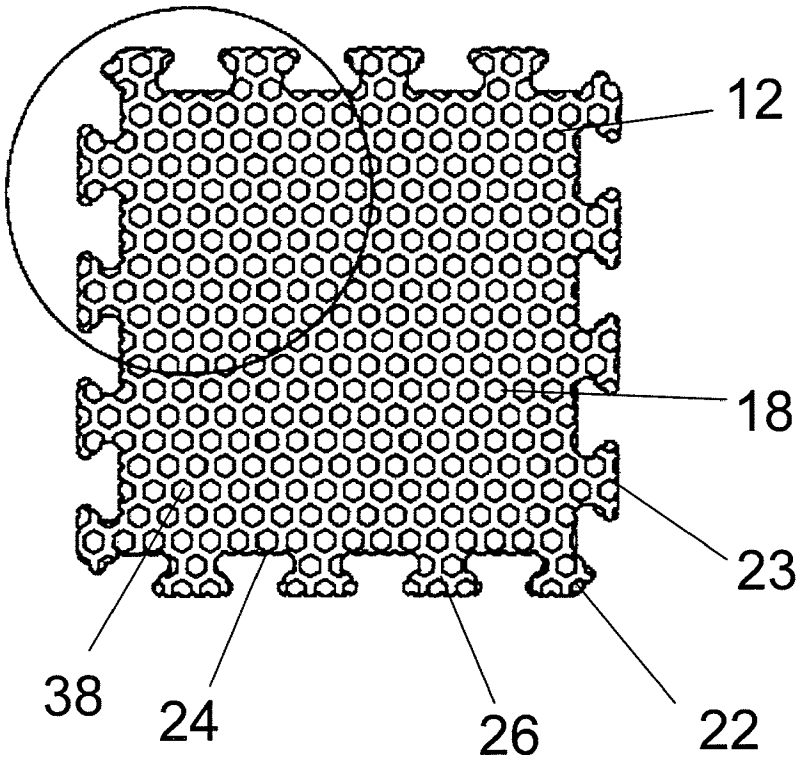
FIG. 7 is a top plan view of an individual panel.

Structure and Relationship of Parts:

Referring to FIG. 1-3, a modular shower pan 10 comprises square panels 12 (although other polygon shapes could be used) that interlock in side by side relation to form a body 14. As shown in FIG. 4, each panel 12 has a planar bottom surface 16 and a top surface 18 that is sloped based upon a preselected drain position 20 on body 14. Each panel 12 has an interlocking profile 22 made up of a plurality of interlocking bulbous projections (keys) 23 and recesses (locks) 24 along each side 26, as detailed in FIG. 5. As shown in FIG. 8, there are glue channels 28 in each interlocking bulbous projection 22 and recess 24 that extend between top surface 18 and bottom surface 16 of each panel 12 to facilitate securing side edges 26 of panels 12. Referring to FIG. 6, each glue channel 28 is made up of a semi-circle 30 that lines up with a corresponding semi-circle 32 on an adjacent panel 12 to form glue channel 28. On the inside surface of each glue channel 28, there are ribs 34 that create a larger bonding surface, and allow for greater bonding strength. Referring to 5, there is also peripheral scoring 36 on each panel 12 to create a frangible connection which allows bulbous projections 22 to be broken off to leave a planar edge free from interlocking profile 22. As shown in FIG. 7-8, an octagon pattern 38 covers both sides 16 and 18 of each panel 12 to provide a better bond to cement or other adhesives when bottom surface 16 is installed on a sub-floor, and when a waterproof membrane is installed on top surface 18.

Operation:

Referring to FIG. 2, the method of installation for modular shower pan 10 begins by measuring the installation dimensions where shower pan 10 is to be installed. For a rectangular shaped shower area 40, this would include the length and width. While a rectangular shape has been shown as an example, pans for floors with other shapes are also possible. If shower area 40 is a shape that is not rectangular, then the dimensions would include the shape and size of floor 40 based on its outer profile 44. The size of drain 20 and its relative positioning within shower area 40 are also determined. The dimensions are then input into a computer, and software is used to calculate an appropriate slope 42 for modular shower pan 10 to ensure proper drainage to drain 20. Referring to FIG. 1, body 14 of panels 12 are temporarily interlocked. The dimensions of body 14 include enough panels 12 to completely cover the dimensions of shower floor 40 (generally four or more). Referring to FIG. 2, a machine then mills slope 42 onto top surface 18 of body 14 to ensure proper drainage to drain 20. A score line 46 indicating required drain position 20 is milled into top surface 18 of body 14. An edge 43 demarking outer profile 44 of shower area 40 is then trimmed, so that shower pan 10 is shipped in the form illustrated in FIG. 3. At a job site, an installer removes panels 12 from their shipping container and assembles panels 12 to reform body 14 by interlocking bulbous projections 22 of one panel with recesses 24 of an adjoining panel. As each panel 12 is installed, it is glued with adhesive to floor area 40, with octagon pattern 38, illustrated in FIG. 5, assisting with such adhesion. In addition, a glue, such as thinset, is used along interlock 22. Referring to FIG. 6, glue channels 28 secures interlock 22 against separation. A waterproof membrane is then installed over top surface 18 to create a water seal.

In some installations, the entire floor area must be raised. In such instances, additional individual panels are shipped which are used to raise the floor. Referring to FIG. 5, during installation, individual panels are trimmed in situ by the installer who breaks off bulbous projections 22 along peripheral scoring 36 on each panel 12 to leave a planar edge free from interlocking profile 22 for positioning along a wall.

Modular shower pan 10, as described in this patent document, is designed to be used with existing shower systems, such as the Schluter Shower System and all its components. It is not limited to standard sizes, as each installation is a custom installation to a particular shape and drain position. When used, modular shower pan 10 eliminates the need for the extensive heavy labour required to install traditional mortar shower pans. After the dimensions of shower floor 40 are taken and the milling of each panel 12 is completed, panels 12 are boxed and brought to shower area 40 to be installed. Because of their light weight and interlocking design, modular shower pan 10 can be rapidly installed, usually in less than 20 minutes, as opposed to five to seven hours with mortar pans. An additional advantage of this system over traditional mortar shower pans includes the fact that there is no need to pre-slope shower floor 40, and no need for a plumber to be present during installation.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A method of installing a modular shower pan, the method comprising the steps of:

determining dimensions including shape and size of a shower area and position of a drain;

determining a slope the shower area must have to ensure drainage to the drain;

trimming a body to the dimensions of the shower area, marking at least one drain position on the body and milling the top surface of the body to contour the top surface to ensure drainage to the at least one drain position; and taking the body apart into at least four polygon panels and forwarding to an installer to install by arranging the at least four polygon panels in the shower area.

2. The method of claim 1, including a step of milling a score line related to the drain position.

3. The method of claim 1, wherein the at least four polygon panels are square panels.

4. The method of claim 1, wherein the polygon panels comprise an interlocking profile.

5. The method of claim 4, wherein the interlocking profile comprises providing a plurality of interlocking bulbous projections and recesses.

6. The method of claim 1, wherein the at least four polygon panels comprise glue channels extending between the top surface and the bottom surface of each panel to facilitate the side edges of the panels being secured.

7. A method of installing a modular shower pan, the method comprising the steps of:

determining dimensions including shape and size of a shower area and position of a drain;

determining a slope the shower area must have to ensure drainage to the drain;

trimming a body to the dimensions of the shower area, marking at least one drain position on the body and milling the top surface of the body to contour the top surface to ensure drainage to the at least one drain position;

taking the body apart and transporting the at least for polygon panels to the shower area; and installing the shower pan by arranging the at least four polygon panels in the shower area.

8. The method of claim 7, including a step of milling a score line related to the drain position.

9. The method of claim 7, wherein the at least four polygon panels are square panels.

10. The method of claim 7, wherein transporting the at least four polygon panels to the shower area comprises forwarding the at least four polygon panels to an installer.

11. The method of claim 7, wherein the polygon panels comprise an interlocking profile.

12. The method of claim 11, wherein the interlocking profile comprises providing a plurality of interlocking bulbous projections and recesses.

13. The method of claim 7, wherein the at least four polygon panels comprise glue channels extending between the top surface and the bottom surface of each panel to facilitate the side edges of the panels being secured.

* * * * *